US005562779A

United States Patent [19]

Allaway et al.

[11] Patent Number: 5,562,779

[45] Date of Patent: Oct. 8, 1996

[54] DEVICE AND METHOD FOR CLEANING PARTICULATE MATERIAL

[75] Inventors: Allan W. Allaway, Underwood; Ian Blair, Rochedale; Allan J. Seefeld, Underwood, all of Australia

[73] Assignee: Synthetic Grass Maintenace Services Pty Ltd., Surfers Paradise, Australia

[21] Appl. No.: 150,080

[22] PCT Filed: May 18, 1992

[86] PCT No.: PCT/GB92/00890

§ 371 Date: May 18, 1994

§ 102(e) Date: May 18, 1994

[87] PCT Pub. No.: WO92/20272

PCT Pub. Date: Nov. 26, 1992

[30] Foreign Application Priority Data

May 20, 1991 [AU] Australia ..... PK6212
Apr. 8, 1992 [AU] Australia ..... 14714/92

[51] Int. Cl.[6] ..... A47L 5/14; A47L 9/08; E01H 1/08

[52] U.S. Cl. ..... 134/10; 134/22.12; 134/22.18; 134/37; 15/345; 15/346; 15/405

[58] Field of Search ..... 134/25.1, 21, 10, 134/22.18, 22.12, 37; 15/34, 405, 345, 346; 241/38, 19, 24

[56] References Cited

U.S. PATENT DOCUMENTS

| | | | |
|---|---|---|---|
| 3,902,219 | 9/1975 | Jones | 15/314 |
| 4,290,165 | 9/1981 | Hiramatsu et al. | 15/330 |
| 5,218,732 | 6/1993 | Pettigrew et al. | 15/4 |
| 5,302,210 | 4/1994 | Whyte | 134/21 |

FOREIGN PATENT DOCUMENTS

| | | |
|---|---|---|
| 890518 | 1/1982 | Belgium . |
| 8804130 | 7/1988 | Germany . |
| 3824710 | 1/1990 | Germany . |
| 9100929 | 4/1991 | Germany . |

*Primary Examiner*—Melvyn Andrews
*Attorney, Agent, or Firm*—Lorusso & Loud

[57] ABSTRACT

A device for renovating synthetic grass playing surfaces which optionally include a layer of particulate material. The device comprises a plenum chamber (10) which directs a fast moving jet of air against the particulate so as to dislodge it and direct the particulate into a manifold (11) which partially surrounds the plenum chamber. The manifold is designed to separate out the fine particles and direct them to a collection area, and to lay the coarse particulate back on the surface. Filtering and collection apparatus is also described.

20 Claims, 4 Drawing Sheets

45
44
56
46
40
53
33
30
41
51
52
36
54
1
34
37
55
50
12
32
35
31
32
43
38

DEVICE AND METHOD FOR CLEANING PARTICULATE MATERIAL

FIELD OF THE INVENTION

This invention relates to the renovation of synthetic playing surfaces particulary, but not exclusively, sporting surfaces such as synthetic grass tennis courts, synthetic bowling greens and synthetic football and like playing fields, which generally include a layer of sand or other coarse particulate matter as part of their structural make up. The invention is primarily concerned with equipment for removing the coarse particulate matter, together with any entrained dirt, from the synthetic grass surface, separating the dirt from the sand, and returning the clean particulate matter to the synthetic grass surface. Another aspect of the invention concerns equipment for softening the layer of sand and/or other particulate matter in synthetic playing surfaces, and this aspect has particular applicability to sporting surfaces which are wet.

Since the invention is primarily concerned with the renovation of synthetic grass tennis courts, it will be described in that context. However, it will be readily apparent to the skilled addressee that the invention has much broader application than this and that such description is given merely by way of illustration.

DESCRIPTION OF THE PRIOR ART

Synthetic grass tennis courts typically comprise a synthetic mat surface from which extend tufts of simulated grass fibres of plastics material. Sand is layered over the mat surface filling the spaces between the tufts so that the tufts remain substantially erect and produce a flat surface which provides a ball rebound similar to a natural grass court surface.

In time, various environmental factors acting on such synthetic grass tennis courts necessitate cleaning or replacement of the sand. Cleaning may be done with high pressure water or with the use of nylon or wire brushes. High pressure water is disadvantageous in that it is a messy process and usually requires replacement of much of the sand and a considerable amount of relevelling. Relevelling is difficult with wet sand and is a laborious, time-consuming process. Nylon brushes are not very successful, particularly when the sand has become highly compacted, and wire brushes damage the synthetic mat and tufts.

OBJECT OF THE INVENTION

It is therefore an object of the present invention to provide equipment for use in renovating synthetic grass tennis courts, for example, which does not have the disadvantages outlined above.

SUMMARY OF THE INVENTION

Accordingly to one aspect of the present invention, there is provided a device for dislodging, entraining and separating coarse and fine particulate matter layered on a synthetic playing surface, characterised in that the device comprises a plenum chamber having a compressed air inlet and at least one air outlet through which air can be expelled at an inclined angle against a playing surface so as to dislodge coarse and fine particulate matter layered thereon and to direct it into an adjacent manifold which extends above said plenum chamber, said manifold including a port located in its upper region through which the fine lightweight particulate matter is exhausted, and an outlet in a lower region by way of which the coarse heavyweight particulate matter is passed back to the playing surface.

The particulate dislodgment, entrainment and separating device is suitably arranged on a framework which permits easy manipulation over the surface to be treated. An arrangement for removing the separated lightweight matter and collecting it may also be included on such a framework. Most preferably, the framework is wheeled so that the device may be pushed or driven over the surface to be treated.

The plenum chamber is preferably an elongate chamber, most suitably of substantially tubular configuration which traverses the device from side to the other, that is, it is arranged such that it extends at approximately right angles to the direction in which the device is adapted to move or be propelled over the ground surface. The plenum chamber has at least one compressed air inlet, most preferably two—on opposing end walls thereof, and at least one outlet of relatively reduced size which effects an increase in the velocity of the air passing therethrough and which directs the air at an angle downwardly beneath the device against the particulate matter to be dislodged and entrained. The outlet may be one or more narrow slits, preferably extending in a straight line transversely of the device or, most preferably, a multiplicity of aligned pin holes. Suitably, the internal bore of each pin hole outlet is countersunk so that a venturi effect is produced by the air passing therethrough. The angle at which the outlet(s) is arranged is such as to provide maximum leverage on the particulate matter to be dislodged, whilst simultaneously directing the dislodged matter towards the inlet of the adjacent manifold. A suitable angle is between 30° and 75°, most preferably about 60° with respect to the synthetic surface. The number of outlets in the plenum chamber will ideally be maximized so that a large number of individual jets of fast moving air can be directed against the particulate surface, thereby optimising the dislodgment forces thereon. This is particularly important when the particulate matter has formed a hard crusty surface as is quite common in tennis court surfaces.

The manifold is suitably a hollow curvilinear duct of semi-cylindrical configuration with a longitudinal particulate inlet located adjacent the outlet(s) of the plenum chamber. The plenum chamber is suitably arranged coaxially with the duct so as to be closely spaced from the playing surface.

One or more baffle plates, preferably two, are arranged to partially enshroud the plenum chamber to prevent the coarse particulate matter from being carried into the manifold port and to direct the coarse particulate matter back onto the playing surface from which it has previously been uplifted. The baffle plates may take the form of curved plates arranged at spaced intervals above the plenum chamber.

In order to assist the circulation of the coarse and fine particulate matter in the manifold, a deflector can suitably be located in the region of the particulate inlet. The deflector may be a planar plate which is angled with respect to the adjacent playing surface so that particulate matter striking its surface is reflected upwardly into the manifold.

The longitudinal inlet of the manifold is suitably located in the front half or foremost section of the device and can, if need be, be covered with a grill or mesh of sufficient aperture to prevent entrainment of large pieces of debris which could conceivably block the manifold or at least impede the operation thereof. This, however, is not usually necessary.

The manifold may include a section adjacent the longitudinal inlet which extends upwardly in a substantially vertical direction and then curves in a constant radius of curvature through a horizontal section to a downwardly directed section which defines a coarse particulate matter outlet.

The manifold is ideally designed so that the wall adjacent the longitudinal inlet extends upwardly therefrom at a constant radius of curvature through a less curved region to a downwardly curved section which defines the outer wall at a coarse particulate outlet.

The coarse particulate matter outlet may be sufficiently larger than the manifold inlet to enable a drop in the velocity of the air as it passes from the manifold inlet to the outlet, thereby to spread the coarse particulate matter on the playing surface in a uniform layer.

The upper region of the manifold incorporates the port through which all lightweight matter is exhausted. The port is simply an opening about which a deflector or similar means can be arranged if necessary to prevent the coarse, particulate matter being sucked therethrough. The coarse particulate matter is directed towards the outlet in the rear section of the manifold due to its heavier and bulkier nature.

In order to assist in the prevention of the coarse particulate matter blowing out from the sides of the device, between the bottom edge of the manifold and the ground surface, a skirt may be provided. This may take the form of a flat metal plate which extends outwardly from the manifold about it's entire perimeter.

As previously mentioned, the particle dislodgment, separation and entrainment device is preferably supported on a wheeled framework. Such a framework is preferably of tubular construction with thin gauge sheet metal walls for minimising the weight of the entire apparatus. A push/pull handle bar is suitably provided at waist-height for easy manipulation, and means enabling the manifold to be lowered close to the ground surface or for raising it when not in use are also included. Such means can comprise a set of pivotal linkages operated by a lever adjacent the push/pull handle.

When an arrangement is provided for removing the separated fine particulate matter and collecting it, this will suitably comprise a cyclone and chamber in combination with a filtering system. The cyclone is conveniently connected directly by way of a flexible duct to the port of the manifold. One form of cyclone comprises a cylinder with a conical head piece which is oriented in a vertical location on the wheeled framework between the manifold and the push/pull handle. An inlet is provided in the sidewall of the cyclone at an intermediate position, and internal plates direct the entrained fine particulate matter around the inner wall towards the bottom of the cyclone to a collection chamber directly beneath it. A filtering system is provided about an exhaust air outlet, or outlets, which is preferably located in the top of the cyclone. The filtering system may comprise one or more bags of filtering material supported from a framework which extends above the outlet(s). The filtering arrangement is designed to prevent any fine particulate matter blowing into the atmosphere while permitting the exhaust air to be expelled therethrough.

Compressed air used to charge the plenum chamber can be supplied from a portable compressor which is either carried by the support framework for the device or is supplied by a separate remote compressor. In this later context, a single compressed air line preferably supplies air to two separate lines connected to opposite ends of the plenum chamber, and a take-off line for driving the equipment.

According to a further aspect of the invention, there is provided a device for softening a synthetic playing surface which has compacted particulate matter layered thereon, characterised in that the device comprises a plenum chamber having a compressed air inlet and at least one air outlet through which air can be expelled at high velocity at an inclined angle against a playing surface so as to dislodge the particulate matter layered thereon, uplifting the particulate matter into an adjacent manifold which extends above said plenum chamber, and drop said uplifted particulate matter back onto the playing surface in a non-compacted layer.

This device has been adapted particularly for synthetic surfaces which are wet and is therefore primarily used on winter sporting fields or those surfaces which are subjected to a lot of rain.

DESCRIPTION OF THE PREFERRED EMBODIMENT

A preferred embodiment of the invention will now be described with reference to the accompanying drawings, in which.

In all the figures, like reference numerals refer to like parts.

Figure 1:
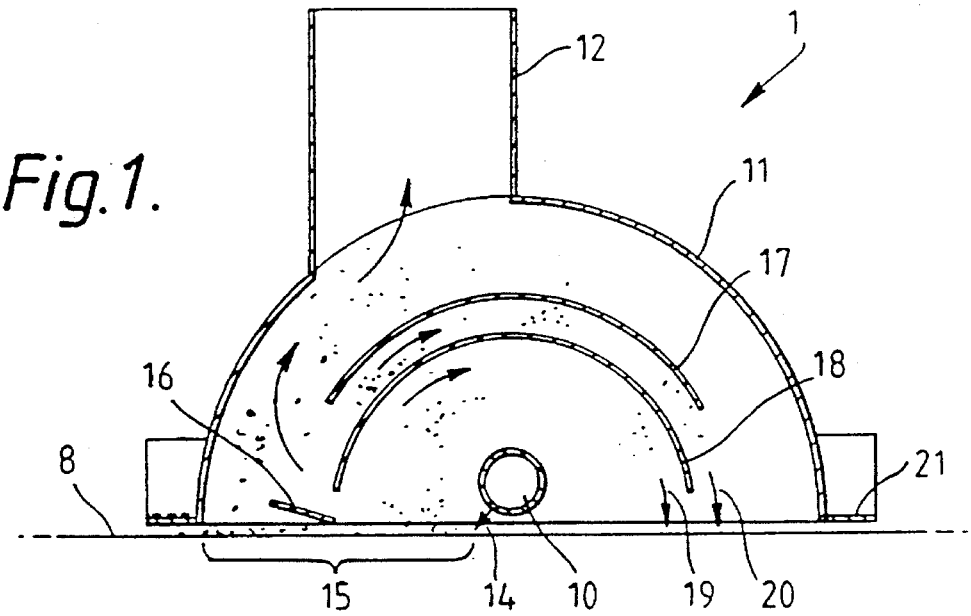
FIG. 1 is an end-on cross-sectional view of a device for dislodging, entraining and separating coarse and fine particulate matter according to the present invention.
Figure 2:
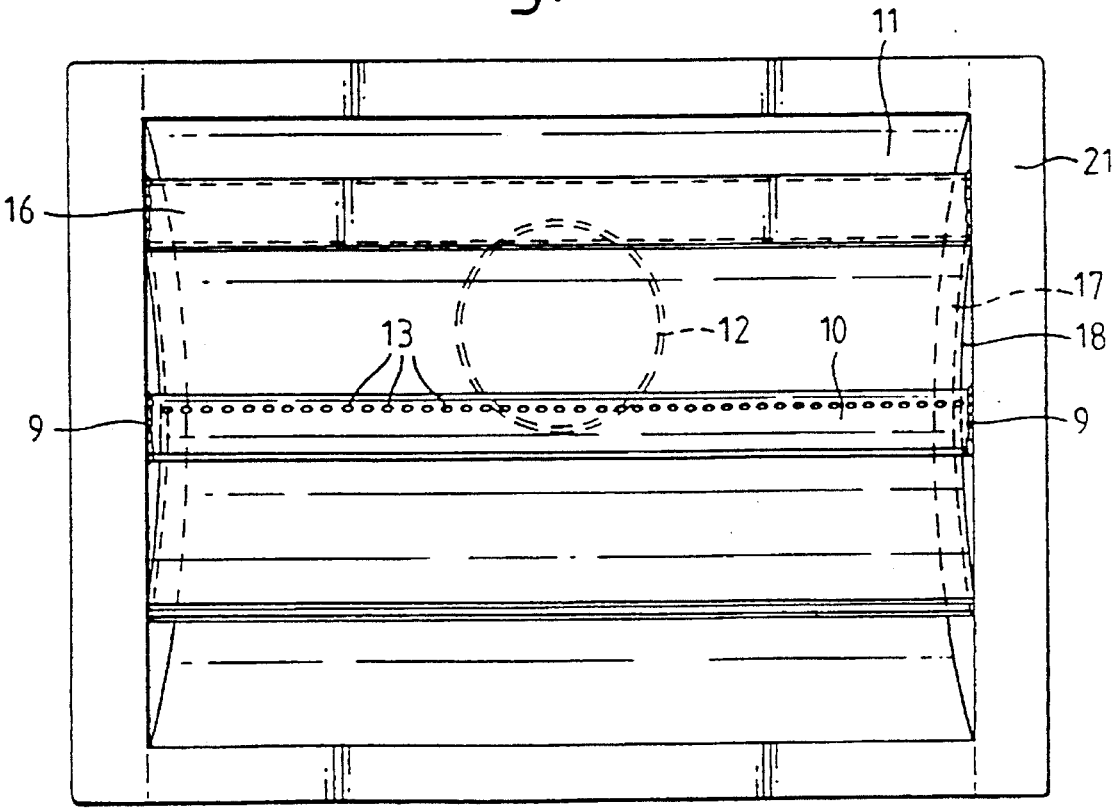
FIG. 2 is a view from below of the device depicted in FIG. 1.

Referring firstly to FIGS. 1 and 2, the device, indicated generally at 1, comprises a plenum chamber 10, a manifold 11 and a port 12.

The plenum chamber 10 is a cylindrical tube which extends from one side of the device to the other in a transverse direction and has a compressed air inlet 9 at each end. It includes a multiplicity of pin hole outlets 13 through which compressed air can be directed at an inclined angle against the particulate ground surface 8, in the direction of arrow 14. This action loosens the particulate matter so that it can be uplifted at the manifold inlet 15 and be entrained in a stream of air which lifts it through the manifold as shown by the arrows. Deflector plate 16 assists in directing the particulate matter in an upward direction.

As the particulate matter is entrained upwardly, separation of the fine and coarse particles occurs due to their differences in momentum. The fine matter tends to be blown forwardly and upwardly for exhaustion through port 12, while the heavier coarser matter tends to lag behind to a certain extent and be deflected by baffles 17, 18 back on to the ground as shown by arrows 19, 20. The coarse particulate matter is, in fact laid back down in a similar array to that from which it was uplifted.

A lip 21 is provided at the perimeter of the manifold to prevent any particulate matter from being blown from the side of the manifold.

Figure 3:
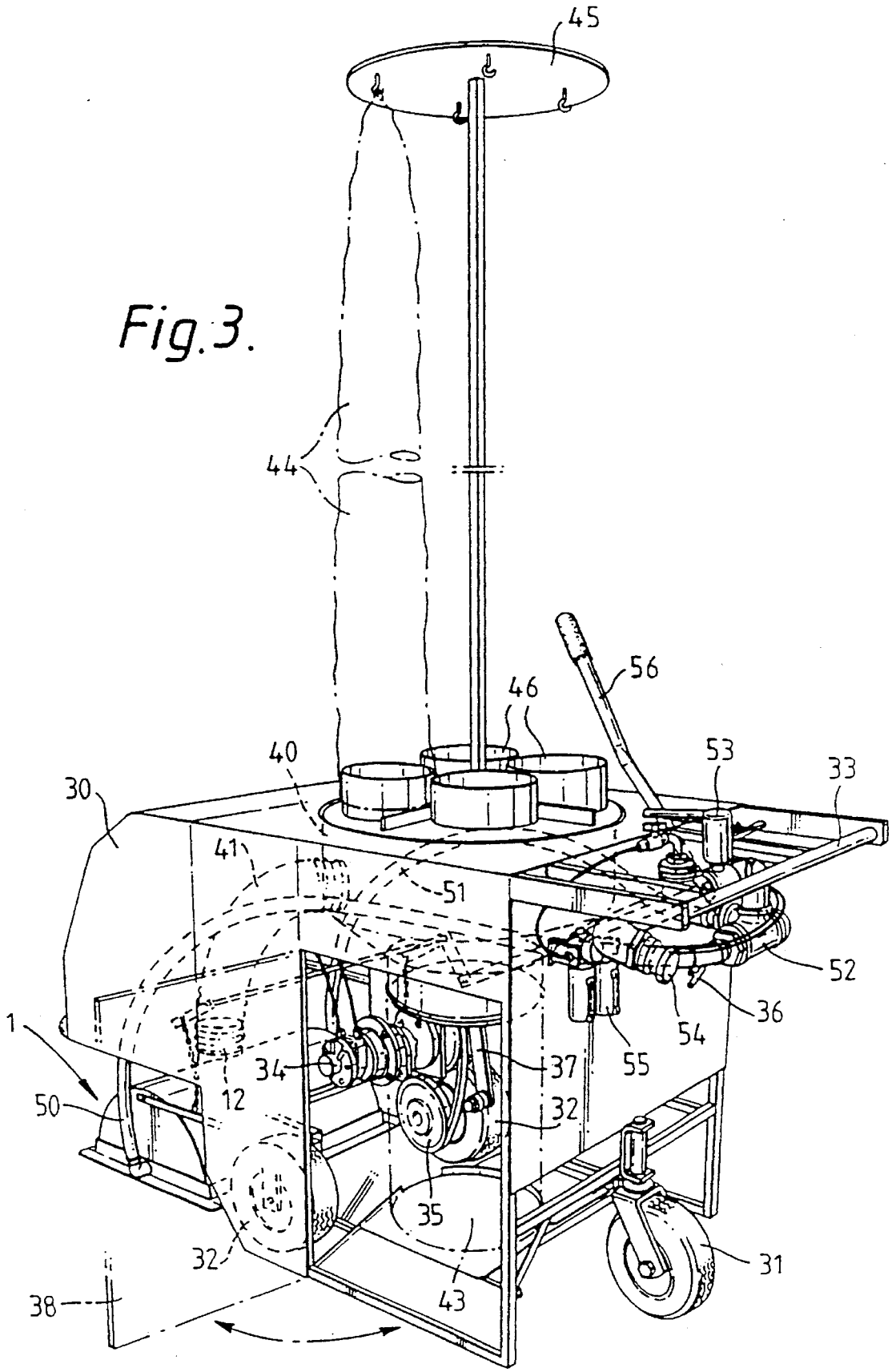
FIG. 3 is an end-on perspective view of the device of FIG. 1 supported on a framework and including a fine particle collecting chamber.

Referring to FIG. 3, the device 1 is supported at the front end of a wheeled structure which includes means for collecting and storing the fine particulate matter as well as an air filtering arrangement and operation controls.

The wheeled structure comprises a panelled framework 30 having a jockey wheel 31 to enable steering with handle 33, and driven wheels 32. Wheels 32 propel the structure forward when compressed air motor 34 engages the wheels through the action of belt pulley 35 which is actuated by lever 36 through a system of levers culminating in linkage arm 37.

Figure 4:
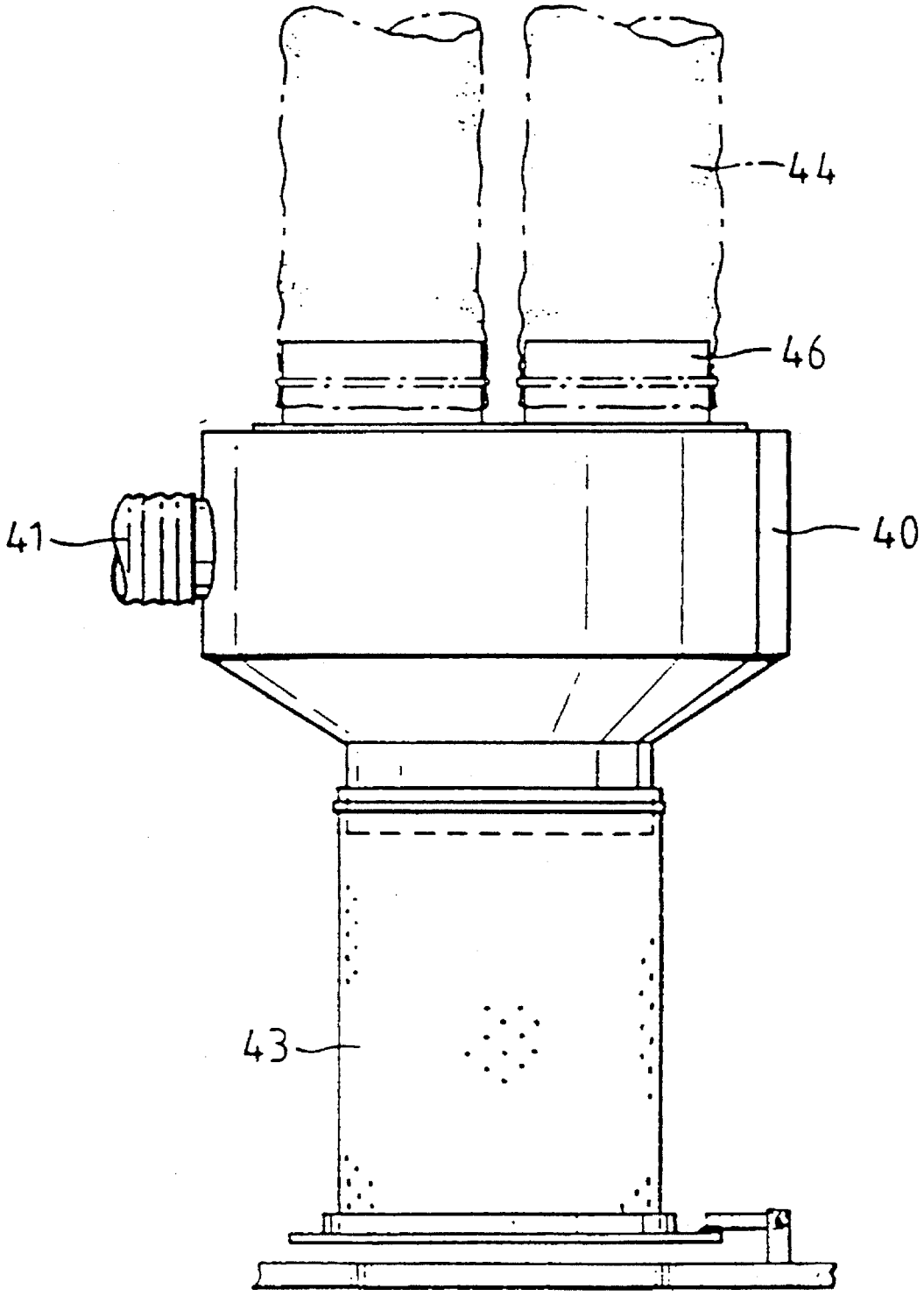
FIG. 4 is a side view of the particle collecting chamber and filters.

The interior of the wheeled structure holds the particulate collecting and storage equipment (see FIG. 4 also) and is accessed through door 38. This equipment comprises a cyclone 40 into which is connected a flexible tube 41 extending from port 12 in the manifold of the device 1. The cyclone includes a number of baffles so that particulate matter in the air is separated and falls into bin 43. Filter socks 44 are supported from a disc 45 and encompass outlets 46 in the top of the cyclone. The filter socks remove all residual fine particulate matter from the air before it is exhausted to the atmosphere.

The plenum chamber is supplied with compressed air by way of high pressure lines 50, 51 which extend through the interior of the wheeled structure to the rear thereof. These lines are joined at a T-piece 52 to which air is admitted by way of control valve 53 and inlet 54. Inlet 54 joins to a separate mobile compressor (not illustrated).

A compressed air take-off compartment 55 is provided to supply air to the air motor 34.

Lever 56 functions to raise and lower the device 1 relative to the ground surface, through a series of linkages.

In operation, high pressure air from a compressor is admitted by way of inlet 54, T-piece 52 and lines 50, 51, to the plenum chamber. The device is lowered to the ground until it is closely spaced therefrom, by means of lever 56. The wheeled structure is then set in forward motion by pressurizing the air motor 34 with air and operating lever 36 so as to engage the belt on its pulley 35.

Air under pressure vents through the pin hole outlets 13 in the plenum chamber and impinges against the ground surface 8. Coarse and fine particulates matter is entrained within the air stream with the coarse matter being blown back onto the surface and the fine particulate matter being entrained in an air stream which exhausts into cyclone 40 by way of flexible tube 41. In the cyclone the air and dust are separated with the residual dust settling into bin 43 and about filter sock 44, and the air venting out through the filter sock 44. The device 40 described is particularly suitable for cleaning the sand of synthetic grass playing surfaces such as tennis courts and for cleaning the particulates from sand-free playing surfaces such as hockey fields.

Figure 5:
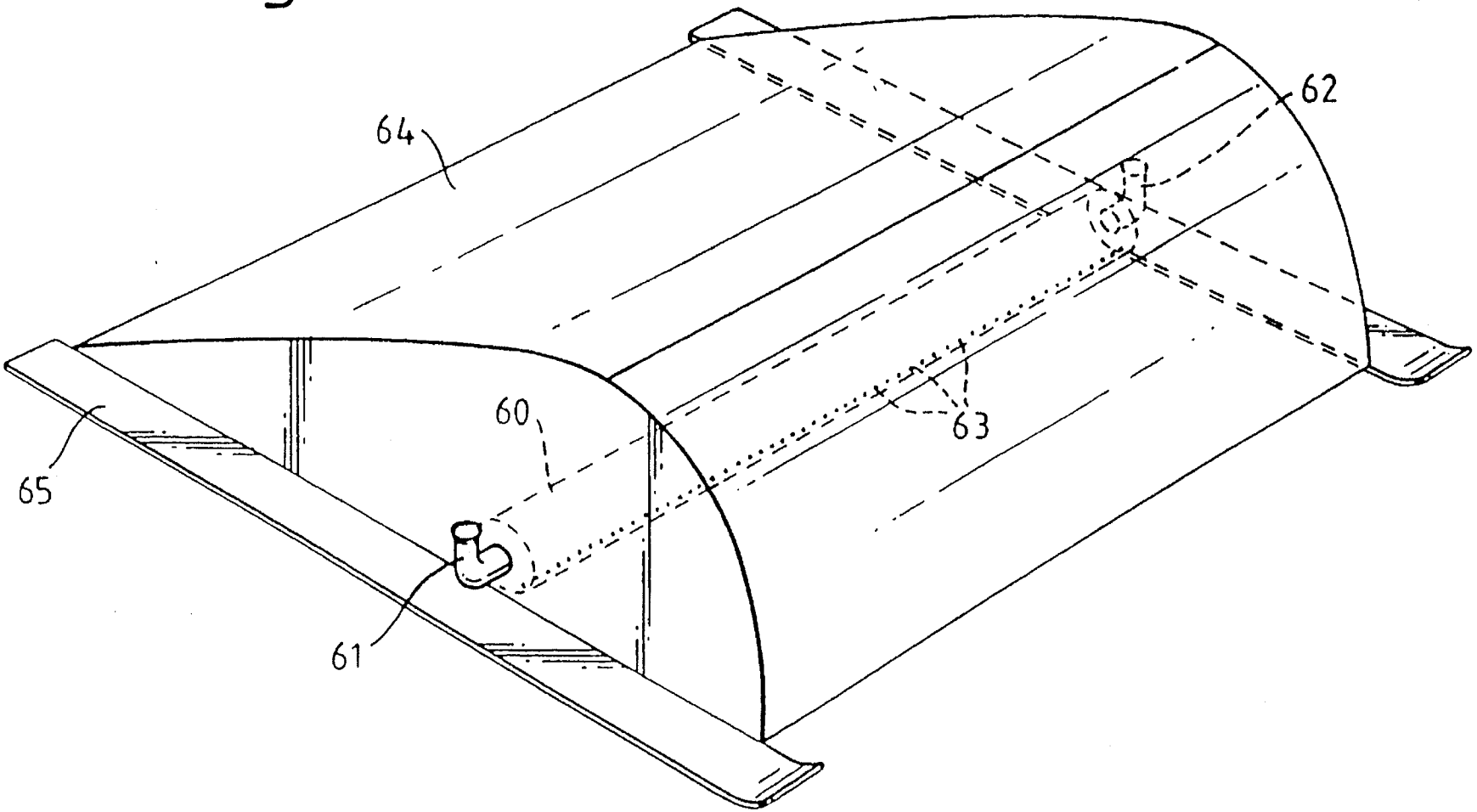
FIG. 5 is a perspective view of a device for treating wet coarse particulate matter.

The device depicted in FIG. 5 is for softening up wet particulate material. It comprises a plenum chamber 60 having compressed air inlet 61, 62 and a plurality of pin hole outlets 63 arranged in a similar manner to those in the device depicted in FIG. 1. The plenum chamber is located within a manifold 64 having a skirt 65. This device may be incorporated into the mobile arrangement of FIG. 3 in place of the FIG. 1 embodiment however since there is no outlet port the collection equipment is not utilized.

In operation, compressed air is directed at high velocity against a wet compacted surface containing particulate matter. The particulate matter is uplifted and then dumped back onto the surface as the device is moved along, thereby producing a soft playing surface. This device is particularly suited to synthetic football and hock fields which have a sand filling.

A typical air pressure employed with both aspects of the invention is 375 cfm at 110 psi, and the diameter of the pin holes is 1.5 mm.

We claim:

1. A device for dislodging, entraining and separating particulate matter layered on a synthetic playing surface, characterized in that the device comprises a plenum chamber having a compressed air inlet and at least one air outlet through which air can be expelled at an inclined angle against the playing surface so as to dislodge the particulate matter layered thereon and to direct the dislodged particulate matter into an adjacent manifold which extends above said plenum chamber, said manifold including a port located in an upper region thereof through which a first proportion of the dislodged particulate matter comprising first particulates is exhausted, and an outlet in a lower region by way of which a second proportion of the dislodged particulate matter comprising second particulates is passed back to the playing surface thereby separating the particulate matter first and second proportions, where the second particulates of the second proportion of the dislodged particulate matter are heavier than the first particulates of the first proportion of the dislodged particulate matter.

2. A device as claimed in claim 1 wherein the plenum chamber is of substantially tubular configuration and extends from a first side of the device to a second side of the device in a substantially horizontal disposition at right angles to the direction in which the device is adapted to be passed over the playing surface.

3. A device as claimed in claim 2, wherein there is an inlet for compressed air at each end of the plenum chamber and the outlet comprises a multiplicity of aligned pin holes formed along a side of the plenum chamber.

4. A device as claimed in claim 3, wherein the pin holes in the plenum chamber are aligned at an angle of approximately 60° with respect to the playing surface.

5. A device as claimed in claim 1, wherein the manifold is a hollow curvilinear duct with a longitudinal inlet located adjacent the outlet in the plenum chamber.

6. A device as claimed in claim 5, wherein the manifold includes a section adjacent the longitudinal inlet which extends upwardly in a substantially vertical direction and then curves in a constant radius of curvature through a horizontal section to a downwardly directed section which defines a course particulate matter outlet.

7. A device as claimed in claim 5, wherein the manifold includes a wall adjacent the longitudinal inlet which extends upwardly therefrom at a constant radius of curvature through a less curved region to a downwardly curved section which defines the outer wall at a coarse particulate outlet.

8. A device as claimed in claim 6, wherein the coarse particulate matter outlet is sufficiently larger than the manifold inlet to enable a drop in the velocity of the air as the air passes from the manifold inlet to the outlet, to thereby spread the second proportion of the dislodged particulate matter on the playing surface in a uniform layer.

9. A device as claimed in claim 1 which includes at least one baffle plate arranged to partially enshroud the plenum chamber in order to prevent the second proportion of the dislodged particulate matter from being carried into the manifold port and to direct the second proportion of the dislodged particulate matter to the manifold outlet.

10. A device as claimed in claim 1 which is supported on a wheeled framework.

11. A device as claimed in claim 10 and including a chamber for collecting the separated first proportion of the dislodged particulate matter, said chamber comprising a cyclone connected at an inlet in a side wall of said chamber to the port in the manifold, by a duct.

12. A device as claimed in claim 11, and including a filtering arrangement connected to an outlet at the top of the cyclone which permits air to vent to the atmosphere while retaining the first proportion of the dislodged particulate matter.

13. A device as claimed in claim 1 and including a compressed air source connected to the plenum chamber for supplying compressed air to the plenum chamber.

14. A device for softening a synthetic playing surface which has compacted particulate matter layered thereon, characterized in that said device comprises a plenum chamber having a compressed air inlet and at least one air outlet through which air can be expelled at high velocity at an inclined angle against the playing surface so as to dislodge the particulate matter layered thereon, uplift the particulate matter into an adjacent manifold which extends above said plenum chamber, and drop said uplifted particulate matter back into the playing surface in a non-compacted layer.

15. A method of dislodging and separating particulate matter from a synthetic playing surface, characterized in that the method comprises the steps of:

directing pressurized air onto and at an inclined angle to, the surface to dislodge the particulate matter therefrom;

separating the dislodged particulate matter into a first proportion comprising first particulates and second proportion comprising second particulates, where the second particulates of the second proportion are heavier than the first particulates of the first proportion; and returning the second proportion of the dislodged particulate matter to the surface.

16. A method according to claim 15, wherein the directing step involves directing the pressurized air through a multiplicity of aligned pin holes.

17. A method according to claim 15, wherein the separating step involves passing the first and second proportions of the dislodged particulate matter through a manifold in which the separating step is carried out.

18. A method according to claim 15 further including the step of collecting the separated first proportion of the dislodged particulate matter.

19. A method of softening a synthetic playing surface of compacted particulate matter, characterized in that the method comprises the steps of:

directing pressurized air onto, and at an inclined angle to, the surface to dislodge the particulate matter, uplifting the dislodged particulate matter, and returning the dislodged particulate matter to the surface in a non-compacted layer.

20. A method according to claim 15, wherein the directing step involves directing the pressurized air at an angle of approximately 60° with respect to the surface.

* * * * *